United States Patent [19]

Easton et al.

[11] 4,248,425

[45] * Feb. 3, 1981

[54] HOLLOW BAT AND METHOD OF MAKING

[75] Inventors: James L. Easton, Los Angeles; Gary W. Filice, Canoga Park, both of Calif.

[73] Assignee: James D. Easton, Inc., Van Nuys, Calif.

[ * ] Notice: The portion of the term of this patent subsequent to Dec. 11, 1996, has been disclaimed.

[21] Appl. No.: 30,617

[22] Filed: Apr. 16, 1979

Related U.S. Application Data

[63] Continuation-in-part of Ser. No. 855,320, Nov. 8, 1977, Pat. No. 4,177,989.

[51] Int. Cl.[3] ..... A63B 59/06

[52] U.S. Cl. ..... 273/72 A; 29/523

[58] Field of Search ..... 273/67 R, 72 R, 72 A, 273/73 J, 81 R; 220/66, 200, 306, 308

[56] References Cited

U.S. PATENT DOCUMENTS

| | | | |
|---|---|---|---|
| 1,931,425 | 10/1933 | Barrett | 273/81 R |
| 3,688,942 | 9/1972 | Mitchell et al. | 220/306 |
| 3,927,466 | 12/1975 | Rosalsky | 273/72 A X |
| 4,177,989 | 12/1979 | Easton et al. | 273/72 A |

*Primary Examiner*—Richard J. Apley

[57] ABSTRACT

A hollow metal ball bat having a hollow end knob encompassing an enlarged section of a hollow handle portion. The opening of the end knob is smaller than the contained enlarged handle portion, and fits over the smaller cross-section of the handle portion adjacent the enlarged portion. A ring of resilient material is held between the end knob and the enlarged handle portion.

2 Claims, 4 Drawing Figures

HOLLOW BAT AND METHOD OF MAKING

This is a continuation-in-part of application Ser. No 855,320, filed Nov. 8, 1977, 4,177,989.

BACKGROUND OF THE INVENTION

This invention relates to a hollow metal baseball bat.

The familiar form of a baseball bat has a relatively large body portion at one end and a relatively small handle portion at the other end. The handle portion is terminated by a knob or ring-like enlargement which serves to prevent the handle from flying out of the batter's hands as the bat is swung. When baseball bats are turned from wood stock, the end knob is simply formed as an integral enlargement at the bottom of the handle portion. In the case of bats formed of hollow metal, technical and economic limitations of the metal forming process generally dictate that the smoothly tapered bat body and integral handle portion be formed as one unit, while the end knob is formed separately and subsequently affixed to the end of the handle.

In one prior art method of making a metal ball bat, the end knob is formed with a plug or extension adapted to be inserted into the hollow end of the bat handle, which is then crimped to hold the knob in place. This method, disclosed in U.S. Pat. No. 3,735,473 to Wilson, requires elaborate and expensive electrical equipment to generate a pulsed magnetic field which deforms or crimps the metal bat handle.

Another prior art metal bat utilizes a metal end knob formed with an interior cavity adapted to fit over the end of the bat handle portion where it is retained by a circumferential weld. The welding process requires expensive and elaborate electrical apparatus and produces a weld bead at the junction of the knob and handle which may be considered unattractive in sports equipment marketed to the general public. The heat produced by the weld can also be detrimental to the parent material from which the bat is manufactured.

SUMMARY OF THE INVENTION

The present invention includes a method of permanently and securely affixing an end knob to the handle portion of a hollow bat body made of a deformable material such as metal, particularly aluminum and aluminum alloys which are favored for non-wooden baseball bats. The method comprises, in the preferred embodiments, providing a hollow metal bat body having a generally cylindrical hollow handle portion at one end. The end of the handle is open and presents a generally circular transverse cross-section. There is also provided a hollow end knob having an interior cavity with a transverse cross-section substantially larger than that of the end of handle portion of the bat body. The cavity is closed at one end by a transverse wall, and is open at the other end. The cavity opening has a transverse cross-section corresponding to that of the handle end of the bat body so that the handle end may be inserted into the knob cavity with its open end abutting the inside surface of the transverse wall. A ring of resilient material is inserted into the knob cavity and surrounds the bat handle.

In accordance with the invention, the knob is positioned over the end of the handle portion of the bat body with the open end of the handle abutting the inside of the transverse wall of the knob cavity and being surrounded by the ring. The end portion of the handle, which is positioned inside the cavity of the end knob, is then deformed outwardly to enlarge its transverse cross-section so that it forms an enlarged annular portion which bears against the ring and cannot be pulled out of the cavity. Preferably, the deformation also enlarges the portion of the handle encompassed by the cavity opening so that it engages the sides of the opening and restrains all movement of the knob relative to the bat body.

The product of this method is a hollow ball bat having an end knob firmly secured to its handle portion by the engagement of the rim of the end knob cavity opening with the outer surface of the handle portion, by the now compressed ring, and, preferably, by the abuttment of the end of the handle portion against the inner surface of the transverse wall of the knob cavity. This arrangement provides a very effective mechanical joint which resists both longitudinal and circumferential movement of the knob relative to the bat body and eliminates any tendency of the bat to ring in the batter's hand. The inclusion of the resilient ring also has the effect of damping other undesirable resonances which are normally set up in a metal bat.

The objects and advantages of the invention will be more fully understood from the following detailed description in conjunction with the accompanying drawing, in which:

DETAILED DESCRIPTION OF THE PREFERRED EMBODIMENT

Figure 1:
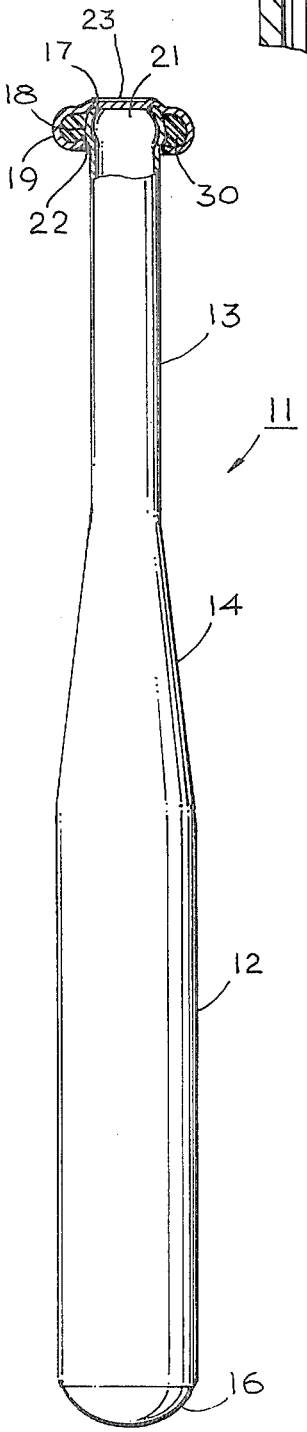
FIG. 1 shows a hollow ball bat manufactured by the method of this invention.

The bat 11 depicted in FIG. 1 is of the familiar shape comprising a generally-cylindrical barrel portion 12 and a generally-cylindrical handle portion 13 connected by a tapered section 14. The body of bat 11 is hollow and is made of a deformable material such as, for example, aluminum or an aluminum alloy. The free end of barrel portion 12 is closed by a cap or plug 16 in any convenient manner known to those skilled in this art. All or part of the bat body may be filled with a resiliently compressible material adapted to dampen vibration, absorb shock and lend structural support to the metal "skin".

The open end 17 of handle portion 13 has an enlarged section 18 near its opening. An end knob 19 is secured to the end of handle 13. The knob 19 has an interior cavity 21 with a transverse cross-section substantially larger than that of handle 13 and an opening 22 corresponding closely to the cross-section of the unenlarged section of handle 13. The depth of cavity 21 is sufficient that the knob 19 is adapted to fit over the end of handle 13 with the edge of opening 22 engaging the surface of the unenlarged section of the handle, while the enlarged section 18 is contained within cavity 21. Cavity 21 is closed by a transverse wall 23. Cavity 21 has a ring 30 of a resilient material such as gum, plastic, or rubber, positioned therein. The ring 30 is deformed by the enlargement of section 18 to fit tightly to the inner wall of the knob 19 and the handle 13 at enlarged section 18. Preferably, the end 17 of handle 13 abuts the inner surface of wall 23, which may be formed with a depression or trough 24 (see FIG. 2) adapted to receive the edge of end 17.

Figure 2:
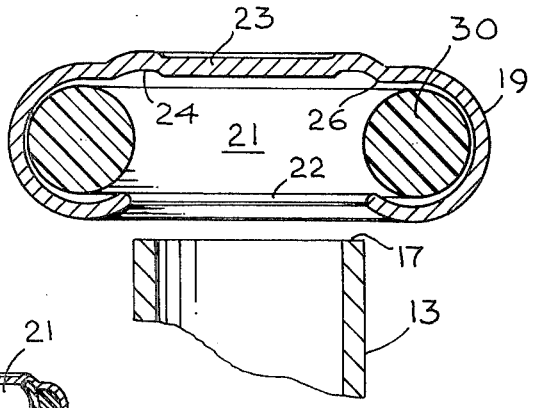
FIGS. 2, 3, and 4 illustrate the sequence of operations performed in manufacturing a hollow ball bat by a preferred embodiment of the method.

The embodiment of the invention shown in FIG. 1 may be formed by a method including the steps of providing a hollow bat body having a generally cylindrical open ended handle portion 13 as illustrated in FIG. 2. There is also provided an end knob 19 having an interior cavity 21 with a transverse cross-section substantially larger than that of handle 13. Cavity 21 has an opening 22 at one end, the opening having a transverse cross-section corresponding to that of handle 13 so that it is adapted to fit closely over the outside of the handle. The other end of cavity 21 is closed by a transverse wall 23, which may include a trough or depression 24 adapted to receive the edge of open end 17 adapted to bear inwardly against the outer edge of end 17 when the handle 13 is in end abutting relation with wall 23.

Figure 3:
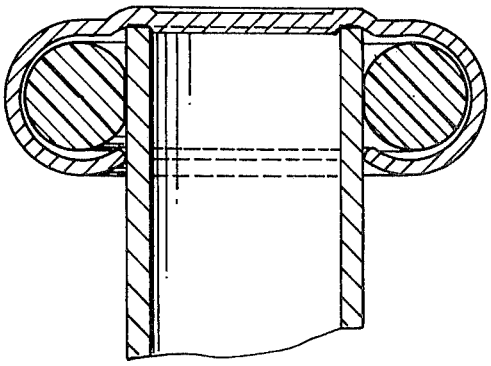

The ring 30 is first placed in the cavity 21 of the knob 19. The end 17 of handle 13 is then inserted into the cavity 21 of knob 19 through cavity opening 22 and through the ring 30 so that it abuts the inner surface of end wall 23, as shown in FIG. 3.

Figure 4:
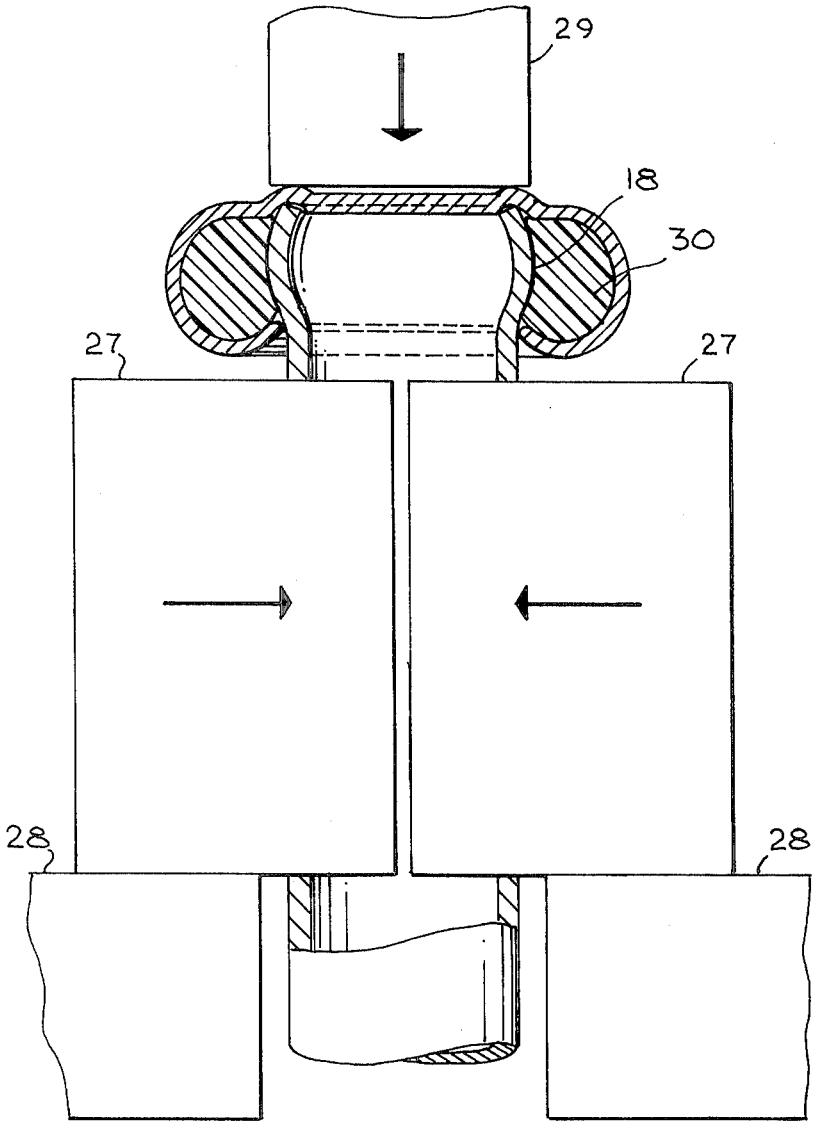

Finally, referring to FIG. 4, handle 13 is gripped just below knob 19 by a pair of encompassing jaws 27 which are supported by a base plate 28, and longitudinal force is applied to the outer surface of transverse end wall 23 by a ram 29, which may be hydraulically activated. The force applied is of a magnitude sufficient to compress axially the end portion of handle 13 which extends above jaws 27 and is largely contained in knob cavity 21. As a result of the compression, the generally cylindrical wall of the end portion 18 of handle 13 is caused to bulge outward, forming a permanently enlarged section inside cavity 21 which compresses the ring 30 and has a transverse cross-section larger than that of cavity opening 22. Thus, handle 13 and knob 19 are securely joined by a relatively simple mechanical process which can be performed economically and without the use of elaborate or complex electrical equipment such as that required for welding or electromagnetic forming as previously practiced. We have discovered that using the ring 30 within the knob 19 adds substantially to the force with which the knob 19 adheres to the handle 17 and eliminates all tendency of the bat to ring. An additional advantage of the ring 30 is that it tends to dampen other vibrations of the bat (in addition to the ringing) and thus makes the bat "feel" more solid.

We have found that in the case of baseball bat bodies made of heat treatable aluminum alloy (type 7046-T6 or type 7178-T6) and having a wall thickness at the handle end in the range of 0.082" to 0.155", a longitudinal pressure of about 23,000 pounds applied with a 1.250" diameter ram which travels about 0.100" will produce the desired formation or bulge of the handle end inside the knob. The section of the handle which is to be deformed should be annealed if the bat body has been previously heat treated. Annealling at a temperature of 660° F. for about 90 seconds has been found satisfactory for a wall thickness of 0.153". The inner diameter of the ring 19 should be just less than the outer diameter of the handle 17, and the ring 19 may be made of 7ON Buna Rubber.

Those skilled in the art to which the invention pertains will recognize that many variations and modifications of the invention are possible and may be performed without departing from its scope and spirit which is not limited to the precise forms and steps disclosed by way of illustration and example but by the appended claims.

What is claimed is:

1. A ball bat comprising a bat body having a generally cylindrical hollow handle portion open at one end and having an enlarged section adjacent the open end; a hollow end knob having an interior cavity of transverse cross-section substantially larger than that of the handle portion of the bat body, the cavity having at one end an opening adapted to fit closely over a handle portion and being closed at the other end by a transverse wall; a ring of resilient material positioned within the interior cavity of the end knob; the end knob being positioned over the enlarged end section of the handle portion of the bat body with the end of the body abutting the transverse wall of the knob and the cavity opening encompassing the handle portion adjacent the enlarged section.

2. A ball bat as in claim 1 wherein the transverse wall of the end knob has a recess of transverse cross-section corresponding to that of the open end of handle portion of the bat body.

* * * * *